US008466329B2

(12) United States Patent
Roets et al.

(10) Patent No.: US 8,466,329 B2
(45) Date of Patent: Jun. 18, 2013

(54) COLD FLOW RESPONSE OF DIESEL FUELS BY FRACTION REPLACEMENT

(75) Inventors: Petrus Nicolaas Johannes Roets, Vanderbijlpark (ZA); Delanie Lamprecht, Vanderbijlpark (ZA)

(73) Assignee: Sasol Technology (Pty) Ltd, Johannesburg (ZA)

( * ) Notice: Subject to any disclaimer, the term of this patent is extended or adjusted under 35 U.S.C. 154(b) by 124 days.

(21) Appl. No.: 12/601,761

(22) PCT Filed: May 30, 2008

(86) PCT No.: PCT/ZA2008/000043

§ 371 (c)(1),
(2), (4) Date: Feb. 1, 2010

(87) PCT Pub. No.: WO2008/148137

PCT Pub. Date: Dec. 4, 2008

(65) Prior Publication Data

US 2010/0179357 A1 Jul. 15, 2010

(30) Foreign Application Priority Data

May 31, 2007 (ZA) ..... 2007/4507

(51) Int. Cl.
*C10L 1/08* (2006.01)

(52) U.S. Cl.
USPC ..... 585/14; 208/15; 208/347; 208/950; 44/300; 518/728; 585/800

(58) Field of Classification Search
USPC ..... 585/14; 208/15, 950; 44/300
See application file for complete search history.

(56) References Cited

U.S. PATENT DOCUMENTS

| | | | | |
|---|---|---|---|---|
| 6,143,043 | A * | 11/2000 | Botros | 44/346 |
| 6,458,265 | B1 * | 10/2002 | Miller et al. | 208/137 |
| 6,723,889 | B2 * | 4/2004 | Miller et al. | 585/739 |
| 6,787,022 | B1 * | 9/2004 | Berlowitz et al. | 208/18 |
| 6,811,683 | B2 * | 11/2004 | Davis et al. | 208/97 |
| 6,833,064 | B2 * | 12/2004 | Berlowitz et al. | 208/15 |
| 7,019,038 | B2 * | 3/2006 | Espinoza et al. | 518/700 |
| 7,217,852 | B1 * | 5/2007 | DeHaan et al. | 585/734 |
| 7,252,754 | B2 * | 8/2007 | DeHaan et al. | 208/15 |
| 7,279,018 | B2 * | 10/2007 | Jakkula et al. | 44/301 |
| 7,294,253 | B2 * | 11/2007 | DeHaan et al. | 208/58 |
| 7,345,210 | B2 * | 3/2008 | Maund et al. | 585/14 |
| 7,345,211 | B2 * | 3/2008 | Espinoza et al. | 585/14 |
| 7,354,462 | B2 * | 4/2008 | O'Rear | 44/300 |
| 2004/0232045 | A1 * | 11/2004 | Simmons et al. | 208/89 |
| 2006/0016722 | A1 * | 1/2006 | Espinoza et al. | 208/14 |

(Continued)

FOREIGN PATENT DOCUMENTS

| | | | |
|---|---|---|---|
| EP | 1 690 919 | A | 8/2006 |
| JP | 2005 002229 | A | 1/2006 |
| JP | 2006 016541 | A | 1/2006 |
| WO | WO 2006/130219 | A | 12/2006 |

*Primary Examiner* — Ellen McAvoy
(74) *Attorney, Agent, or Firm* — Knobbe Martens Olson & Bear LLP

(57) ABSTRACT

A method of preparing an FT derived diesel composition wherein the FT derived diesel composition has a good response to CFPP improving additives, which good response is achieved by addition of one or more of a FT recycle stream, a crude-oil derived diesel fuel, and a HGO (Heavy Gas Oil) to an FT derived diesel thereby to improve the CFPP improving additive response thereof.

24 Claims, 1 Drawing Sheet

U.S. PATENT DOCUMENTS

2006/0201850 A1* 9/2006 DeHaan et al. ..... 208/15
2007/0100177 A1* 5/2007 Clark et al. ..... 208/15
2007/0187292 A1* 8/2007 Miller et al. ..... 208/15
2007/0187293 A1* 8/2007 Cherrillo et al. ..... 208/15

* cited by examiner

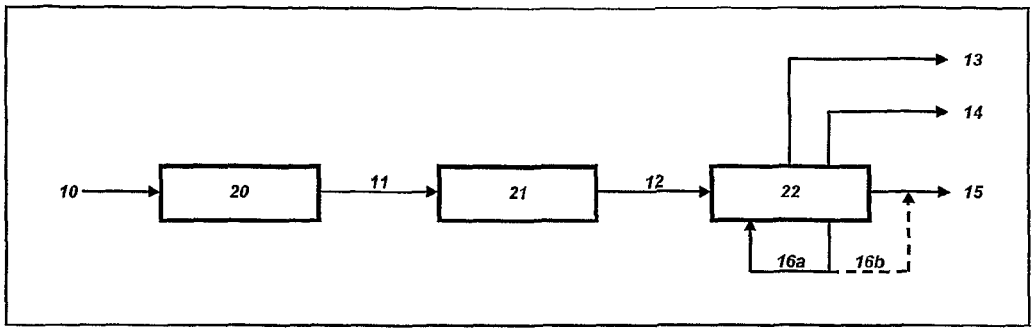
13
14
10
20
11
21
12
22
15
16a
16b

COLD FLOW RESPONSE OF DIESEL FUELS BY FRACTION REPLACEMENT

CROSS-REFERENCE TO RELATED APPLICATIONS

This application is the national phase under 35 U.S.C. §371 of prior PCT International Application No. PCT/ZA2008/000043 which has an International filing date of May 30, 2008, which designates the United States of America, and which claims the benefit of South African Application No. 2007/4507 filed May 31, 2007, the disclosures of which are hereby expressly incorporated by reference in their entirety and are hereby expressly made a portion of this application.

FIELD OF THE INVENTION

The invention relates to maintaining and/or improving cold flow properties of Fischer Tropsch (FT) derived fuels by replacing a fraction of the FT fuel.

BACKGROUND TO THE INVENTION

In cold climates the Cold Filter Plugging Point (CFPP) of diesel fuels is very important and is specified in various standards such as the EN590 diesel fuel specification where the climate related requirements varies from −20° C. CFPP for countries such as Germany to −10° C. and −5° C. for countries such as Portugal and Greece. CFPP, measured according to the IP 309 and CEN EN116 test methods, is widely accepted for predicting low-temperature performance. It is the highest temperature at which a given volume of fuel fails to pass through a standardized filtration device in a specified time when cooled under standardized conditions.

The CFPP of FT derived diesel can be improved either by reducing the T95 cut point of the diesel or with the use of an additive. Alternatively, the CFPP of the GTL diesel can be improved by changing the process operating conditions or through a combination of the above options. To obtain a "winter" grade FT derived diesel conforming to a grade F CFPP specification of −20° C. with fixed process conditions and isocracking catalyst, the tail of the diesel needs to be fractionated lighter to remove the heavy waxy paraffinic hydrocarbons from the diesel pool. A consequence of such action includes yield losses.

CFPP improver additives work in two ways; by nucleation and by growth inhibition. These additives, are formulated in such a way that as the fuel cloud point is reached, it creates a large number of nuclei to which the first separating wax molecules attach themselves and form crystals. Growth inhibiting CFPP additives inhibit the normal development of wax crystals through adsorption onto the growing crystal surface, preventing plate-like growth. The resulting crystals have a more compact shape and will be less prone to agglomerate. Large numbers of small crystals form as a result and can pass more easily through filter screens that enable the engine to keep running.

One of the most important fuel characteristics influencing cold flow additive response is its wax content which will depends on the distillation profile of the fuel. Complex refineries with many downstream cracking units results in diesel with a narrow boiling range and are more difficult to treat.

The cold flow properties of diesel can either be improved by cutting lighter and remove the heavy tail of the diesel or it can be improved with a CFPP improver. It is known that removing the tail of the diesel will result in a decreased effect of a cold flow improver additive on its CFPP with a decrease in wax content of the fuel.

Surprisingly an approach has been found which overcomes the above known problem for improving the CFPP additive response of FT derived diesel.

SUMMARY OF THE INVENTION

Fractionation of the heavy ends of FT derived diesel to form a light FT diesel, in an effort to obtain good cold flow properties, will result in yield losses of about 5% from a T95 of 352° C. to 328° C.

CFPP improving additives can be added to the FT diesel as an alternative. CFPP addition to fuel follows a law of diminishing returns with the depression of CFPP becoming smaller as the treat levels increase.

Light FT derived fuels containing n-paraffins where the concentration of hydrocarbon atoms of C20 and below is low are difficult to treat and may show decreased CFPP additive response.

According to a first aspect of the invention, a good response of FT derived diesel to CFPP improving additives is achieved by addition of a FT recycle stream to the FT derived diesel to improve the CFPP improving additive response.

The FT recycle stream may typically have the following fraction boiling points.

| | Recycle bottoms after fractionation at 360 deg C. |
|---|---|
| Initial boiling point | 203.5° C. |
| 5% | 394.5° C. |
| 10% | 383.5° C. |
| 20% | 414.0° C. |
| 30% | 422.0° C. |
| 40% | 428.0° C. |
| 50% | 440.0° C. |
| 60% | 450.0° C. |
| 70% | 466.0° C. |
| 80% | 480.5° C. |
| 90% | 502.5° C. |
| 95% | 521.0° C. |

A typical FT recycle stream has the following physical properties:

| | |
|---|---|
| Ash | <0.01% mass |
| Density @ 20° C. | 0.8177 |
| Gross Heating value | 47958 |
| Flash Point | 196° C. |
| Pour Point | 30° C. |
| Total Sulphur | <0.01% mass |
| Viscosity @ 50 Kin | 18.45 cSt |
| Viscosity @ 100 Kin | 5.6 cSt |
| Water Content | <0.05% mass |

The FT derived diesel may be a light FT diesel.

The FT derived diesel may have a >C19 wax content of less than 3.5 mass %, in some embodiments less than 2.4 mass %, even less than 1.8 mass %, typically 1.6 mass %.

The FT derived diesel may have a CFPP of −9° C. to −18° C., typically −14° C. to −18° C.

The FT derived diesel may have a CFPP of less than −14° C.

The FT derived diesel may have a CFPP of below −18° C.

The FT recycle stream may include C24 and higher carbon number hydrocarbons. Typically more than 95 mass % of the FT recycle stream is C24 and higher.

The FT recycle may be an FT recycle from a hydroprocessing unit, more particularly a hydrocracking unit, as shown in FIG. 1 below.

The FT recycle stream may be added at a rate of from 0.1 vol % to 10 vol % of the final diesel composition, preferably 0.1 vol % to 5 vol %, typically 3 vol %.

The CFPP of the diesel composition including the FT recycle stream and the CFPP improving additives may be below −15° C., preferably below −18° C., more preferably below −20° C.

The improvement in the CFPP of the diesel composition including the FT recycle stream and the CFPP improving additives may be 2° C. or more, typically 4° C. or more.

The CFPP improving additives are usually present at a concentration of from 50 ppm to 1000 ppm, typically 500 ppm.

According to a second aspect of the invention, a good response of FT derived diesel to CFPP improving additives is achieved by addition of a crude-oil derived diesel fuel to the FT derived diesel to improve the CFPP improving additive response.

The crude-oil derived diesel may include C19 and higher carbon number hydrocarbons. Typically, the C19 and higher carbon number hydrocarbons of the crude-oil derived diesel is in excess of 1.5 mass %, typically in excess of 10 mass %, more typically 15 mass %.

The FT derived diesel may be a light FT diesel.

The FT derived diesel may have a >C19 wax content of less than 3.5 mass %, in some embodiments less than 2.4 mass %, even less than 1.8 mass %, typically 1.6 mass %.

The FT derived diesel may have a CFPP of −9° C. to −18° C., typically −14° C. to −18° C.

The FT derived diesel may have a CFPP of less than −14° C.

The FT derived diesel may have a CFPP of below −18° C.

The crude-oil derived diesel may be added at a rate of from 0.1 vol % to 10 vol % of the final diesel composition. Typically the crude-oil derived diesel is added at a rate of from 0.5 vol % to 6 vol %, usually 1 vol % or 5 vol %.

The improvement in the CFPP of the diesel composition including the crude-oil derived diesel and the CFPP improving additives may be 2° C. or more, typically 4° C. or more.

The CFPP of the FT derived diesel composition including the crude-oil derived diesel fuel and the CFPP improving additives may be below −15° C., preferably below −18° C., more preferably below −20° C.

The invention extends to the use of an FT recycle stream as a blending component with an FT derived diesel as a CFPP improving additive response improver.

The invention extends to the use of a crude-oil derived diesel as a blending component with an FT derived diesel as a CFPP improving additive response improver.

According to a third aspect of the invention, a good response of FT derived diesel to CFPP improving additives is achieved by addition of a Heavy Gas Oil (HGO) to the FT derived diesel to improve the CFPP additive response.

The HGO may be added at a rate of from 0.1 vol % to 5 vol % of the final diesel composition.

The FT derived diesel may be a light FT diesel.

The FT derived diesel may have a >C19 content of less than 3.5 mass %, in some embodiments less than 2.4 mass %, even less than 1.8 mass %, typically 1.6 mass % . . . .

The FT derived diesel may have a CFPP of −9° C. to −18° C., typically −14° C. to −18° C.

The FT derived diesel may have a CFPP of less than −14° C.

The FT derived diesel may have a CFPP of below −18° C.

Typically, the C19 and higher carbon number hydrocarbons of the HGO is in excess of 10 mass %, even excess of 14%, typically 15 mass %.

The improvement in the CFPP of the diesel composition including the HGO and the CFPP improving additives may be 5° C. or more, typically 10° C. or more.

The CFPP of the FT derived diesel composition including the HGO and the CFPP improving additives may be below −15° C., preferably below −18° C., more preferably below −20° C., even below −28° C., typically −30° C.

The invention extends to the use of an HGO (High Gravity Oil) as a blending component with an FT derived diesel as a CFPP improving additive response improver

SPECIFIC EXAMPLES OF CARRYING OUT THE INVENTION

The invention will now be described, by way of non-limiting examples only, with reference to the accompanying examples and the process diagram, FIG. 1.

In FIG. 1, Natural gas (10) is fed to a reformer (20) under reforming processing conditions to produce syngas (11) comprising predominantly of hydrogen and carbon monoxide in a specific ratio. The syngas is fed to a FT Synthesis reactor (21) in order to catalytically produce Primary FT products (12) also called syncrude. The syncrude is then fed to a Product Work-up unit (22) where it gets hydroprocessed, including hydrocracked, to produce the following products: LPG (13), Naphtha (14), Diesel (15) and a recycle stream (16*a*, 16*b*). Some part or the whole fraction of the recycle stream (16*a*) may be sent back to the hydroprocessing unit (22), in this case a hydrocracking unit, whereas only a portion of the recycle stream (16*b*) may be sent to the diesel product (15) in order to improve the cold flow additive response of this diesel.

EXAMPLE 1

Addition of FT Recycle Stream to FT Derived Diesel to Improve CFPP Additive Response The CFPP of FT derived diesel can also be improved by a CFPP improving additive. For use of FT diesel in European countries where a winter specification of −20° C. CFPP is required, the use of an additive on its own may not be effective. The fuel would therefore need to be fractionated (removal of the heavy ends) and will therefore lead to loss in yield.

A narrower FT diesel will not have good CFPP improver response and the use of fractionation, together with the use of a CFPP improver will therefore not be possible to reduce the CFPP of the diesel further.

As an example, FT diesel was fractionated (removal of heavy ends) to obtain FT diesel with three different final boiling points (FBP) and three different CFPP values. Selected fuel properties are shown in Table 1. Process operating conditions, including reactor temperature, liquid hourly space velocity (LHSV) and reactor pressure were kept constant with the sampling of the three lower CFPP (−9° C., −14° C. and −18° C.) products.

TABLE 1

| Selected FT diesel fuel properties | | | | |
|---|---|---|---|---|
| | | FT derived diesel sample | | |
| Property | Units | −9 CFPP | −14 CFPP | −18 CFPP |
| Density @ 20° C. | kg/l | 0.7693 | 0.7674 | 0.7634 |
| Density @ 15° C. (calc) | kg/l | 0.7731 | 0.7712 | 0.7673 |
| Distillation corrected to 101,325 kPa | vol-% | | | |
| IBP | ° C. | 180 | 174 | 171 |
| 5% | ° C. | 202 | 202 | 193 |
| 10% | ° C. | 209 | 208 | 199 |
| 20% | ° C. | 220 | 217 | 208 |
| 50% | ° C. | 263 | 258 | 248 |
| 90% | ° C. | 337 | 325 | 314 |
| 95% | ° C. | 352 | 339 | 328 |
| FBP | ° C. | 359 | 346 | 336 |
| Flash point at 101,325 kPa | ° C. | 61 | 60 | 61 |
| Kinematic viscosity at 40° C. | cSt | 2.41 | 2.29 | 2.03 |
| Derived Cetane number (IQT) | | 79 | 76 | 74 |
| Corrected Derived Cetane number | | 85 | 81 | 79 |
| Cold filter plugging point | ° C. | −9 | −14 | −18 |
| Cloud Point | ° C. | −6.9 | −13.4 | −17.8 |
| Total sulphur | mg/kg | <1 | <1 | <1 |

TABLE 2

| CFPP additive response to FT derived diesel with various end points using additive U | | | | | | | | |
|---|---|---|---|---|---|---|---|---|
| | CFPP (° C.) | | | | | Paraffin content | | |
| FT diesel | Dosage (ppm) | | | | | total | >C19 | 90%-20% |
| sample | 300 | 500 | 700 | 800 | 1000 | mass % | mass % | ° C. |
| −9° C. CFPP | — | −18 | — | −18 | −20 | 41.4 | 3.4 | 116 |
| −14° C. CFPP | — | −15 | — | — | −17 | 40.0 | 2.3 | 106 |
| −18° C. CFPP | — | −18 | −18 | — | −20 | 39.6 | 1.6 | 105 |

Only the −9° C. CFPP sample responded well to a CFPP additive at typical dosage rates of less than 500 ppm. Poor CFPP additive response to the −18° C. CFPP GTL diesel product can be explained by the low presence (1.6 mass %) of >C19 heavier n-paraffins in the diesel.

With the addition of a small amount of the FT recycle stream, containing C24 and higher hydrocarbons, blends thereof with the narrow cut, low CFPP FT diesel will contain adequate amount of waxes for the CFPP additive to adsorb onto without influencing the other good fuel properties of the FT diesel. Dosing of a CFPP improver to such a blend of FT diesel with small amount (1 vol %) of FT recycle stream may then have an even better CFPP than the narrow cut FT diesel on its own (refer to table 3).

TABLE 3

| FT derived diesel (−18° C. CFPP) blends with FT recycle stream + 500 ppm CFPP improver | | |
|---|---|---|
| Description | CFPP | Units |
| FT derived Diesel Blend With 1 vol % recycle + CFPP improver | −20 | deg C. |
| FT derived Diesel Blend With 3 vol % recycle + CFPP improver | −21 | deg C. |
| FT derived diesel + CFPP improver | −18 | Deg C. |

EXAMPLE 2

Addition of Crude Oil Derived Diesel to FT Derived to Improve the CFPP Additive Response In this approach, blends of FT derived diesel with Diesel Unifier (DU) diesel (containing processed FCC LCO), were prepared. The DU diesel is a mildly hydrotreated crude-oil derived diesel. The DU diesel had a CFPP of +5° C. and FT derived diesels with CFPP values of, −9° C. and −18° C. were evaluated.

Blends of DU diesel with −18° C. CFPP FT derived diesel (>C19=1.6% and 90%−20%=105° C.) and a CFPP improver were evaluated (see Table 4). A 2° C. and 3° C. CFPP improvement was observed with a 1% and 5% DU diesel blend and 500 ppm CFPP improver. The CFPP improver dosage rate was increased to 1000 ppm and a 4° C. CFPP (CFPP=−24° C.) improvement was observed with the −18° C. CFPP FT derived diesel with a 5% DU diesel blend (see Table 5 below).

TABLE 4

| FT derived diesel (−18° C. CFPP) blends with DU diesel + 500 ppm CFPP improver | | | |
|---|---|---|---|
| Description | CFPP | Cloud Point | Units |
| FT derived Diesel Blend With 1 vol % DU Diesel | −17 | −12 | deg C. |
| FT derived Diesel Blend With 1 vol % DU Diesel + CFPP improver | −20 | −14 | deg C. |
| FT derived Diesel Blend With 5 vol % DU Diesel | −17 | −14 | deg C. |
| FT derived Diesel Blend With 5 vol % DU Diesel + CFPP improver | −21 | −13 | deg C. |
| FT derived diesel + CFPP improver | −18 | −17 | Deg C. |

TABLE 5

| FT derived diesel (−18° C. CFPP) blends with DU diesel + 1000 ppm CFPP improver | | | |
|---|---|---|---|
| Description | CFPP | Cloud Point | Units |
| FT derived Diesel Blend With 1 vol % DU Diesel + CFPP improver | −21 | −13 | deg C. |
| FT derived Diesel Blend With 5 vol % DU Diesel + CFPP improver | −24 | −11 | deg C. |
| FT derived diesel + CFPP improver | −20 | −17 | Deg C. |

EXAMPLE 3

Addition of HGO Diesel to FT Derived to Improve the CFPP Additive Response

The −18° C. CFPP FT derived diesel product, having only 1.6 mass % of higher paraffins, was blended with 5 vol-% heavy gas oil (HGO) to increase the amount of heavier n-paraffins (>C19) in the blend. Although the Cloud Point (CP) and CFPP of this blend raised considerably (see Table 6), a target CFPP of −30° C. could be met with 1000 ppm of Additive U.

TABLE 6

Selected fuel properties of HGO and the blend containing 5 vol % of the HGO with GTL diesel

| | CP (° C.) | CFPP (° C.) | Density (15° C.) kg/m³ | Paraffin content total mass % | Paraffin content >C19% |
|---|---|---|---|---|---|
| HGO | −17.5 | −14 | 867.8 | 25.4 | 15.2 |
| −18° C. CFPP | −17.8 | −18 | 768.1 | 39.6 | 1.6 |
| −18° C. CFPP + 5% HGO | −11.5 | −12 | 773.3 | 38.9 | 2.2 |
| −18° C. CFPP + 5% HGO + additive U | | −30 | | | |

Only a few percentage of HGO was necessary to improve the response behaviour of the middle distillate cold flow improver in the "winter" FT derived diesel.

The invention claimed is:

1. A method for preparing a diesel composition, consisting of:

fractionating a Fischer-Tropsch derived diesel to remove heavy waxy paraffinic hydrocarbons, such that a light Fischer-Tropsch derived diesel component having a >C19 wax content of less than 3.5 mass % is obtained; and adding at least one component selected from the group consisting of a Fischer-Tropsch recycle stream from a hydroprocessing unit and a Fischer-Tropsch recycle stream from a hydrocracking unit to the light Fischer-Tropsch derived diesel component, wherein the Fischer-Tropsch recycle stream comprises in excess of 95 mass % of C24 and higher carbon number hydrocarbons, whereby a diesel composition is obtained, wherein the diesel composition exhibits a greater response to a cold filter plugging point improving additive than does the Fischer-Tropsch derived diesel component.

2. The method of claim 1, further comprising adding to the light Fischer-Tropsch derived diesel component at least one component selected from the group consisting of a heavy gas oil and a crude oil derived diesel, wherein the crude oil derived diesel comprises in excess of 1.5 mass % C19 and higher carbon number hydrocarbons.

3. The method of claim 1, further comprising adding a cold filter plugging point improving additive to the light Fischer-Tropsch derived diesel component, wherein the cold filter plugging point improving additive comprises from 50 ppm to 1000 ppm of the diesel composition.

4. The method of claim 1, wherein the light Fischer-Tropsch derived diesel component has a >C19 wax content of less than 1.6 mass %.

5. The method of claim 1, wherein the light Fischer-Tropsch derived diesel component has a cold filter plugging point of from −9° C. to −18° C.

6. A method for preparing a diesel composition, consisting of:

fractionating a Fischer-Tropsch derived diesel to remove heavy waxy paraffinic hydrocarbons, such that a light Fischer-Tropsch derived diesel component having a >C19 wax content of less than 3.5 mass % is obtained; and adding at least one component selected from the group consisting of a Fischer-Tropsch recycle stream from a hydroprocessing unit and a Fischer-Tropsch recycle stream from a hydrocracking unit to the light Fischer-Tropsch derived diesel component, wherein the Fischer-Tropsch recycle stream comprises from 0.1 vol. % to 10 vol. % of the diesel composition, whereby a diesel composition is obtained, wherein the diesel composition exhibits a greater response to a cold filter plugging point improving additive than does the Fischer-Tropsch derived diesel component.

7. The method of claim 6, wherein the light Fischer-Tropsch derived diesel component has a >C19 wax content of less than 1.6 mass %.

8. The method of claim 6, wherein the light Fischer-Tropsch derived diesel component has a cold filter plugging point of from −9° C. to −18° C.

9. The method of claim 6, wherein the Fischer-Tropsch recycle stream comprises from 0.1 vol. % to 5 vol. % of the diesel composition.

10. The method of claim 6, wherein the Fischer-Tropsch recycle stream comprises 3 vol. % of the diesel composition.

11. The method of claim 6, wherein the cold filter plugging point of the diesel composition is below −15° C.

12. The method of claim 6, wherein the cold filter plugging point of the diesel composition is below −18° C.

13. The method of claim 6, wherein the cold filter plugging point of the diesel composition is below −20° C.

14. The method of claim 6, wherein the cold filter plugging point of the diesel composition is at least 2° C. better than a cold filter plugging point of the light Fischer-Tropsch derived diesel component.

15. The method of claim 6, wherein the cold filter plugging point of the diesel composition is at least 4° C. better than a cold filter plugging point of the light Fischer-Tropsch derived diesel component.

16. The method of claim 6, further comprising adding a cold filter plugging point improving additive to the light Fischer-Tropsch derived diesel component wherein the cold filter plugging point improving additive comprises from 50 ppm to 1000 ppm of the diesel composition.

17. The method of claim 16, wherein the cold filter plugging point improving additive comprises 500 ppm of the diesel composition.

18. The method of claim 6, wherein the diesel composition has a >C19 wax content of less than 3.5 mass %.

19. The method of claim 6, wherein the diesel composition has a >C19 wax content of less than 1.6 mass %.

20. The method of claim 6, further comprising adding to the light Fischer-Tropsch derived diesel component at least one component selected from the group consisting of a heavy gas oil and a crude oil derived diesel, wherein the crude oil derived diesel comprises in excess of 1.5 mass % C19 and higher carbon number hydrocarbons.

21. The method of claim 20, wherein the C19 and higher carbon number hydrocarbons comprise in excess of 10 mass % of the crude oil derived diesel.

22. The method of claim 20, wherein the crude oil derived diesel comprises from 0.1 vol. % to 10 vol. % of the diesel composition.

23. The method of claim 20, wherein the crude oil derived diesel comprises from 0.5 vol. % to 6 vol. % of the diesel composition.

24. The method of claim 20, wherein the heavy gas oil comprises from 0.1 vol. % to 5 vol. % of the diesel composition.

* * * * *

UNITED STATES PATENT AND TRADEMARK OFFICE

CERTIFICATE OF CORRECTION

PATENT NO. : 8,466,329 B2
APPLICATION NO. : 12/601761
DATED : June 18, 2013
INVENTOR(S) : Roets et al.

It is certified that error appears in the above-identified patent and that said Letters Patent is hereby corrected as shown below:

In the Specification

In column 5 (Table 1) line 10, Change "101,325" to --101.325--.

In column 5 (Table 1) line 16, Change "101,325" to --101.325--.

In the Claims

In column 8 at line 45, In Claim 16, after "component" insert --,--.

Signed and Sealed this
Twenty-ninth Day of October, 2013

Teresa Stanek Rea
*Deputy Director of the United States Patent and Trademark Office*